US008397978B2

(12) United States Patent
Wang

(10) Patent No.: US 8,397,978 B2
(45) Date of Patent: Mar. 19, 2013

(54) COLLAPSIBLE TRIANGULAR STORAGE CONTAINER-BASED COMBINATION STORAGE CONTAINER

(76) Inventor: Wen-Tsan Wang, Taipei (TW)

( * ) Notice: Subject to any disclaimer, the term of this patent is extended or adjusted under 35 U.S.C. 154(b) by 219 days.

(21) Appl. No.: 12/986,158

(22) Filed: Jan. 6, 2011

(65) Prior Publication Data

US 2012/0175408 A1 Jul. 12, 2012

(51) Int. Cl.
*B65D 5/12* (2006.01)
*B65D 5/36* (2006.01)
*B65D 21/02* (2006.01)

(52) U.S. Cl. ..... 229/115; 220/23.4; 229/117.01; 229/120.01; 229/125.19

(58) Field of Classification Search ..... 229/115, 229/117.01, 117.02, 120.01, 125.19
See application file for complete search history.

(56) References Cited

U.S. PATENT DOCUMENTS 664,835 A * 1/1901 Czarniecki ..... 229/117.01
1,240,564 A * 9/1917 Harrington ..... 229/115
1,821,741 A * 9/1931 Dalton ..... 229/115
3,185,378 A * 5/1965 Rosenburg, Jr. ..... 229/115
4,258,847 A * 3/1981 Nierman ..... 220/23.4
4,333,602 A * 6/1982 Geschwender ..... 229/125.39
6,536,655 B1 * 3/2003 Humphrey ..... 229/115
2007/0210142 A1 * 9/2007 Wang ..... 229/117.01
2008/0099542 A1 * 5/2008 Bondarik ..... 229/117.07

* cited by examiner

*Primary Examiner* — Gary Elkins
(74) *Attorney, Agent, or Firm* — Leong C. Lei

(57) ABSTRACT

A collapsible triangular storage container-based combination storage container includes multiple collapsible triangular storage containers attached together to form a rectangular configuration, each triangular storage container including a triangular container body having three upright side panels hinged to one another and a folding line on one upright side panel on the middle, a soft and collapsible bottom panel horizontally connected to the three upright side panels at the bottom side, a hard triangular plate member insertable into the inside of the triangular container body to support the triangular container body in shape, and magnetic members fixedly mounted in one upright side panels at two opposite sides relative to the folding line in reversed directions for creating a magnetic attractive force to secure the upright side panels of the triangular container body in a stack when the triangular container body is collapsed after removal of the hard triangular plate member.

3 Claims, 10 Drawing Sheets

COLLAPSIBLE TRIANGULAR STORAGE CONTAINER-BASED COMBINATION STORAGE CONTAINER

BACKGROUND OF THE INVENTION a) Field of the Invention

The present invention relates to triangular storage containers and more particularly, to a collapsible triangular storage container-based combination storage container that enables multiple collapsible triangular storage containers to be detachably and selectively secured together by means of magnetic attraction to form any of many different combinations.

b) Description of the Related Art

Many commercial folding collapsible storage containers are known and can be collapsed to reduce the dimension when not in use, saving much the storage space. A collapsible storage container is known a fabric container body, a plurality of horizontal top rods and horizontal bottom rods respectively horizontally fastened to the top and bottom sides of the vertical peripheral panels of the fabric container body, and a plurality of vertical rods respectively vertically fastened to the junction between each two vertical peripheral panels of the fabric container body. Further, each vertical peripheral panel of the fabric container body has crossed folding lines. If the storage container is not in use, the user can twist the horizontal top rods relative to the horizontal bottom rods to collapse the storage container.

The known conventional collapsible storage containers are commonly made in a rectangular shape for storage purpose only. A user cannot use multiple collapsible storage containers to constitute different combinations.

SUMMARY OF THE INVENTION

The present invention has been accomplished under the circumstances in view. It is therefore the main object of the present invention to provide a collapsible triangular storage container-based combination storage container, which enables multiple collapsible triangular storage containers to be detachably and selectively secured together by means of magnetic attraction to form any of many different combinations.

To achieve this and other objects of the present invention, a collapsible triangular storage container-based combination storage container comprises a plurality of collapsible triangular storage containers that can be attached together to form a rectangular configuration. Each triangular storage container comprises a triangular container body, a plurality of magnetic members and a hard triangular plate member. The triangular container body comprises a first upright side panel having opposing first and second lateral sides and a folding line vertically extending to opposing top and bottom sides thereof on the middle between the opposing first and second lateral sides to divide the first upright side panel into two equal halves for allowing folding of the triangular container body into a collapsed flat condition, a second upright side panel having a first lateral side hinged to the first lateral side of the first upright side panel and a second lateral side, a third upright side panel having a first lateral side hinged to the second lateral side of the second upright side panel and a second lateral side hinged to the second lateral side of the first upright side panel, a soft and collapsible bottom panel horizontally fastened to a bottom side of each of the first upright side panel, the second upright side panel and the third upright side panel and defining with the first upright side panel, the second upright side panel and the third upright side panel a triangular holding space. The magnetic members are symmetrically and fixedly mounted in the two equal halves of the first upright side panel in reversed directions for creating a magnetic attractive force to secure the two equal halves of the first upright side panel in a stack when the triangular container body is collapsed. The hard triangular plate member is to be inserted into the inside of the triangular container body and closely attached to the soft and collapsible bottom panel of the triangular container body to support the triangular container body in shape.

Further, in one example of the invention, two collapsible triangular storage containers can be attached together to constitute a combination rectangular storage container. In another example of the invention, four collapsible triangular storage containers can be attached together to constitute a combination rectangular storage container.

Each collapsible triangular storage container further comprises a triangular container cover for covering the top open side of the triangular container body.

Further, a rectangular container cover is provided for covering the constituted combination rectangular storage container.

Further, the upright side panels of the triangular container body can be respectively formed of a hard plate member and wrapped in a cloth covering.

DETAILED DESCRIPTION OF THE PREFERRED EMBODIMENT

Figure 1:
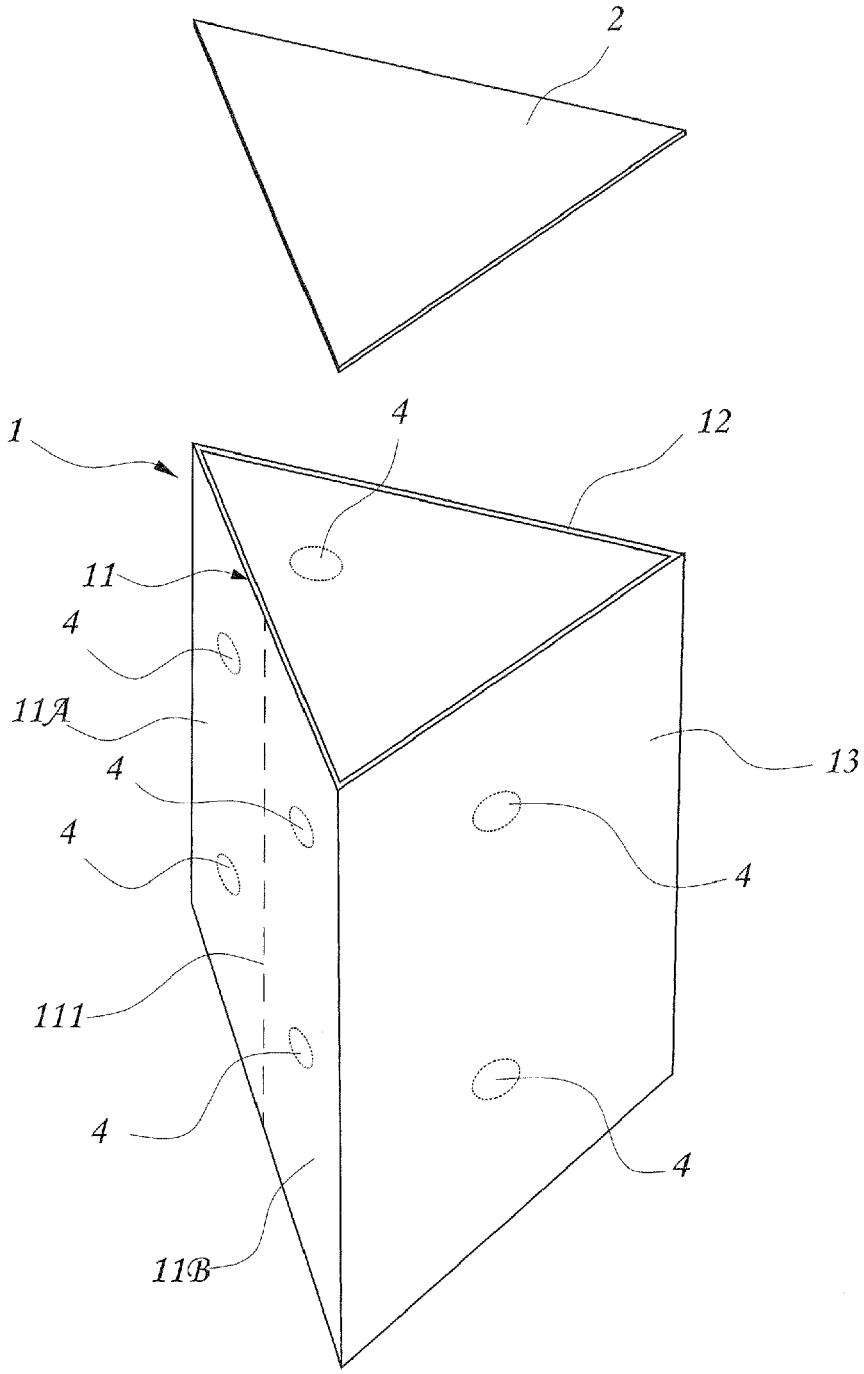
FIG. 1 is an exploded view of a collapsible triangular storage container in accordance with a first embodiment of the present invention.
Figure 2:
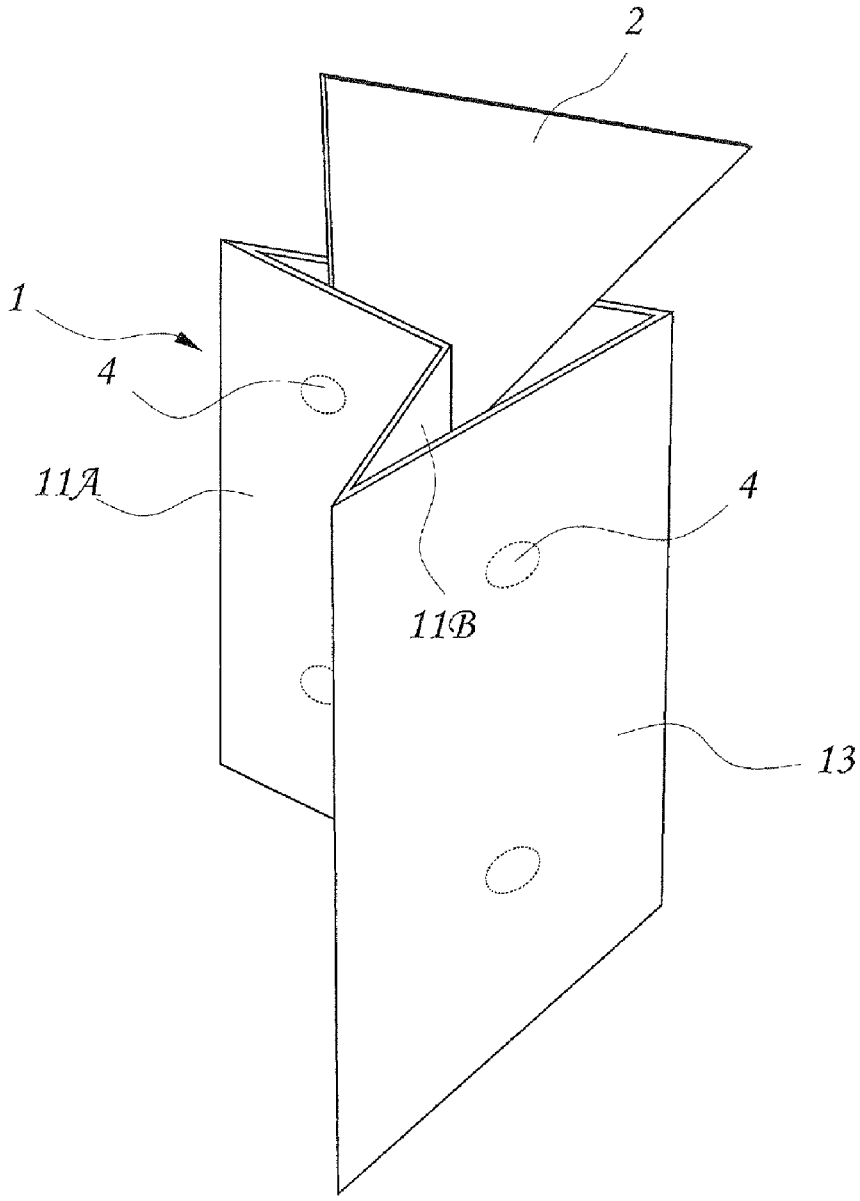
FIG. 2 is a schematic drawing illustrating the triangular plate member inserted into the collapsed triangular container body in accordance with the first embodiment of the present invention.
Figure 3:
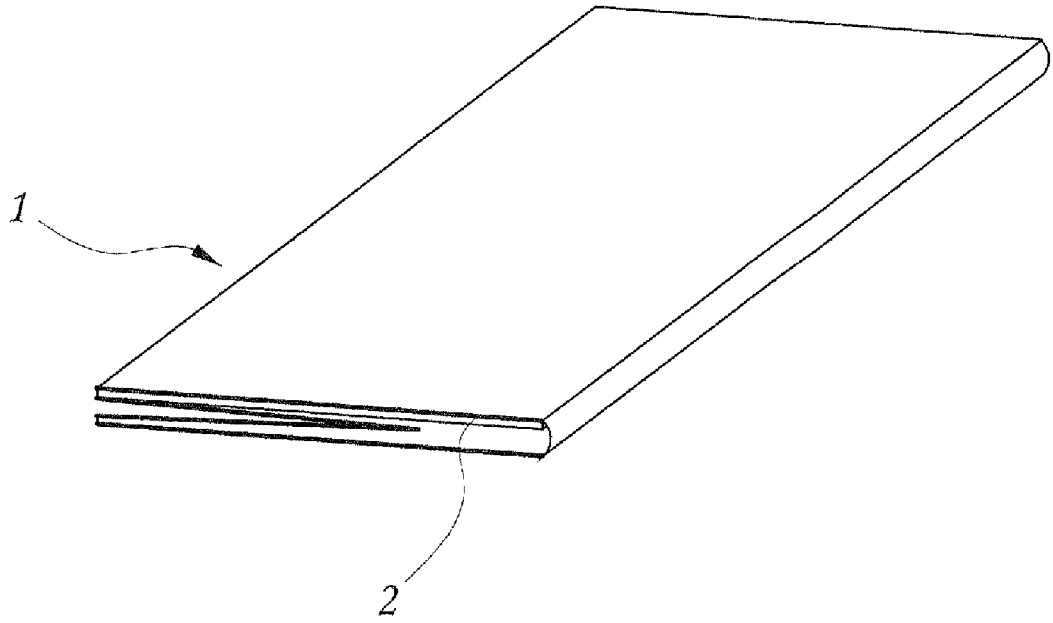
FIG. 3 illustrates the collapsible triangular storage container of the first embodiment of the present invention collapsed and kept in a flat condition.

Referring to FIGS. 1~3, a collapsible triangular storage container in accordance with the present invention is shown comprising a triangular container body 1 and a triangular plate member 2.

The triangular container body 1 comprises three upright side panels, namely, the first upright side panel 11, the second upright side panel 12 and the third upright side panel 13 hinged to one another, a soft and collapsible bottom panel (not shown) horizontally fastened to the bottom side of each of the three upright side panels 11~13 and defining with the three upright side panels 11~13 a triangular holding space. The three upright side panels 11~13 are respectively formed of a hard plate member and wrapped in a cloth covering. Further, the first upright side panel 11 has folding line 111 extending to the top and bottom sides thereof on the middle and dividing the first upright side panel 11 into a first half 11A and a second half 11B. By means of the folding line 111, the first upright side panel 11 can be folded up to have the first half 11A, the second half 11B, the and the second upright side panel 12 and the third upright side panel 13 be closely attached together in a stack. Further, magnetic members 4 are respectively installed in the first half 11A, the second half 11B, the second upright side panel 12 and the third upright side panel 13 at selected locations. The magnetic members 4 at the first half 11A and the magnetic members 4 at the second half 11B are arranged in reversed direction such that the magnetic members 4 at the first half 11A can attach the magnetic members 4 at the second half 11B when the triangular container body 1 is collapsed. Further, the triangular plate member 2 is a hard member to be inserted into the inside of the triangular container body 1 and closely attached to the soft and collapsible bottom panel of the triangular container body 1 to support the triangular container body 1 in shape. When collapsible triangular storage container is not in use, remove the triangular plate member 2 from the triangular container body 1, and then fold up the first upright side panel 11 along the folding line 111 to have the first half 11A, the second half 11B, the and the second upright side panel 12 and the third upright side panel 13 be closely attached together in a stack and the magnetic members 4 at the first half 11A be attached to the magnetic members 4 at the second half 11B to secure the triangular container body 1 in the collapsed flat condition. Further, the triangular plate member 2 can be inserted in between the second upright side panel 12 and the third upright side panel 13 of the collapsed triangular container body 1.

Figure 4:
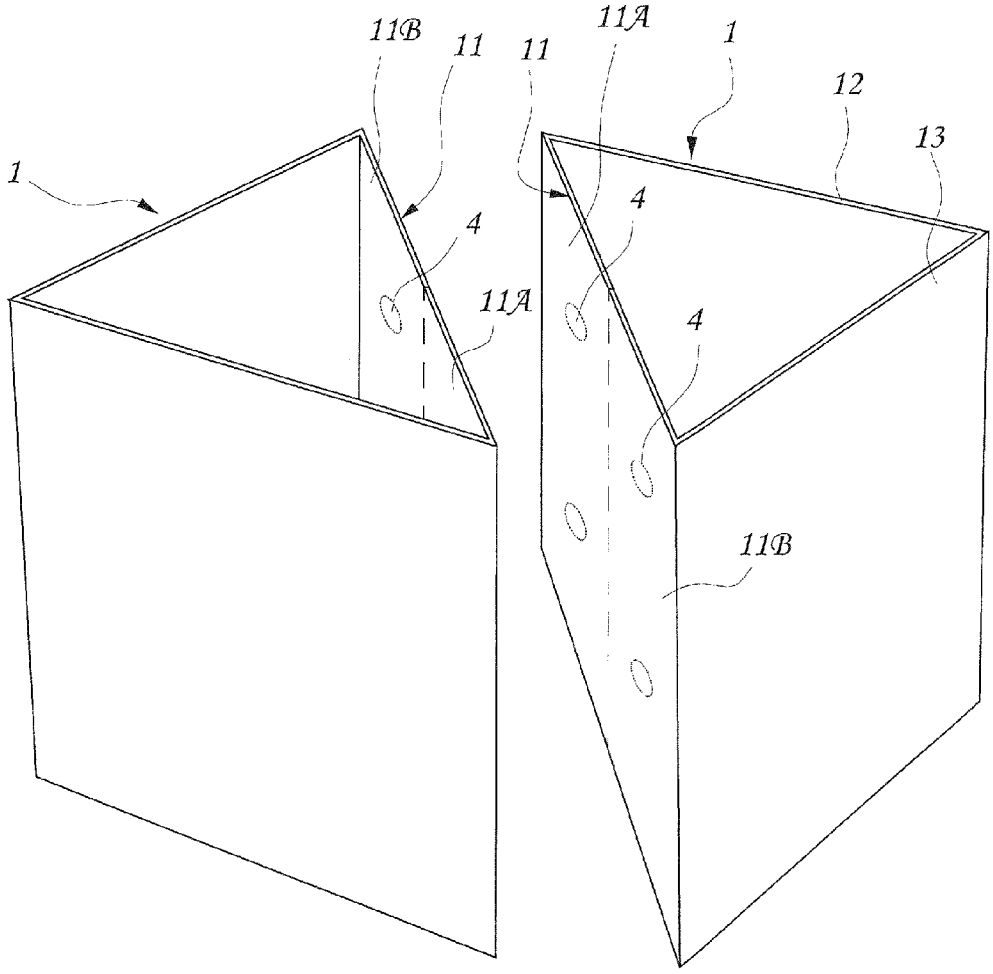
FIG. 4 is a schematic drawing illustrating an application example of the first embodiment of the present invention.
Figure 5:
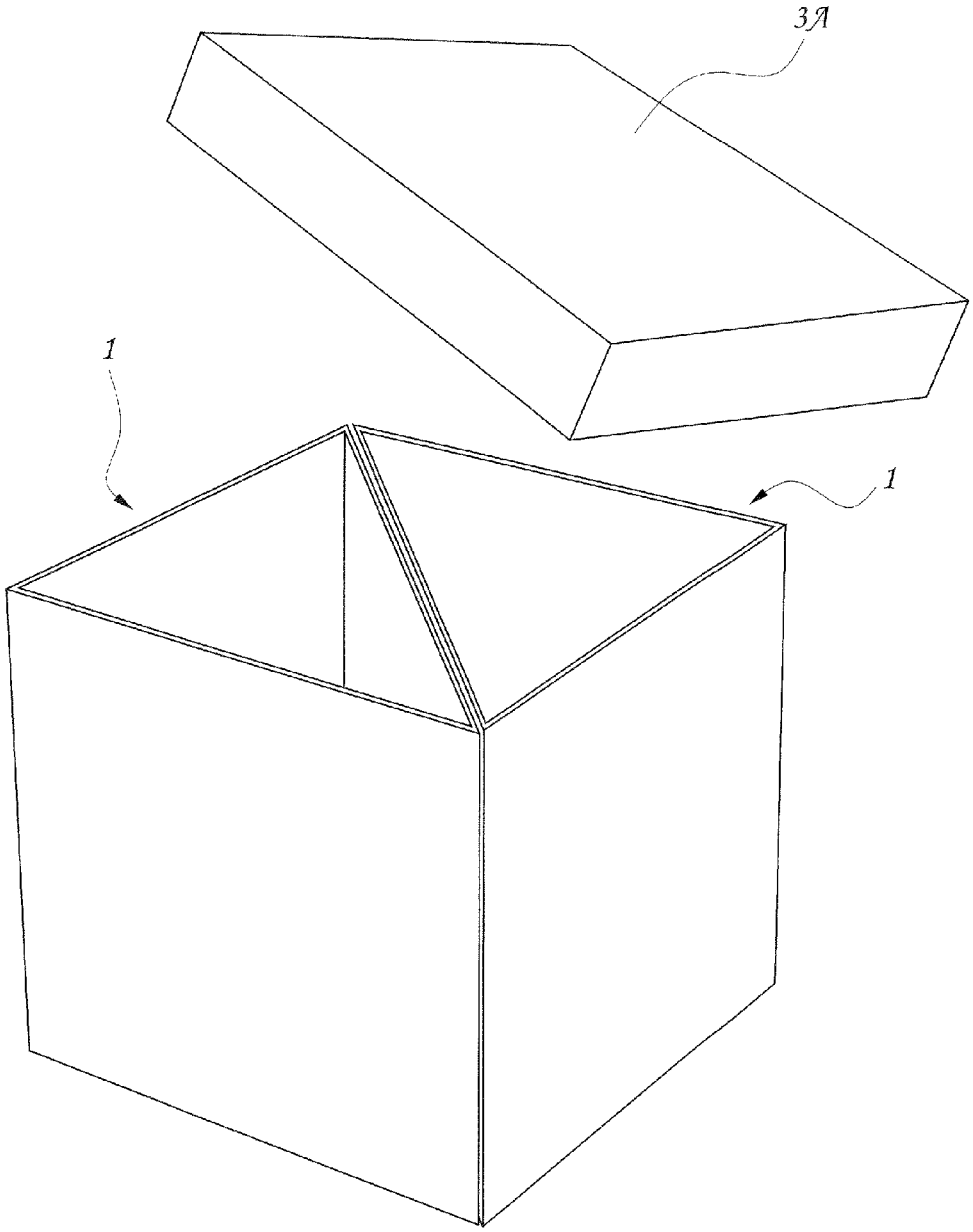
FIG. 5 corresponds to FIG. 4, illustrating the two collapsible triangular storage containers attached together and used with a rectangular container cover.
Figure 6:
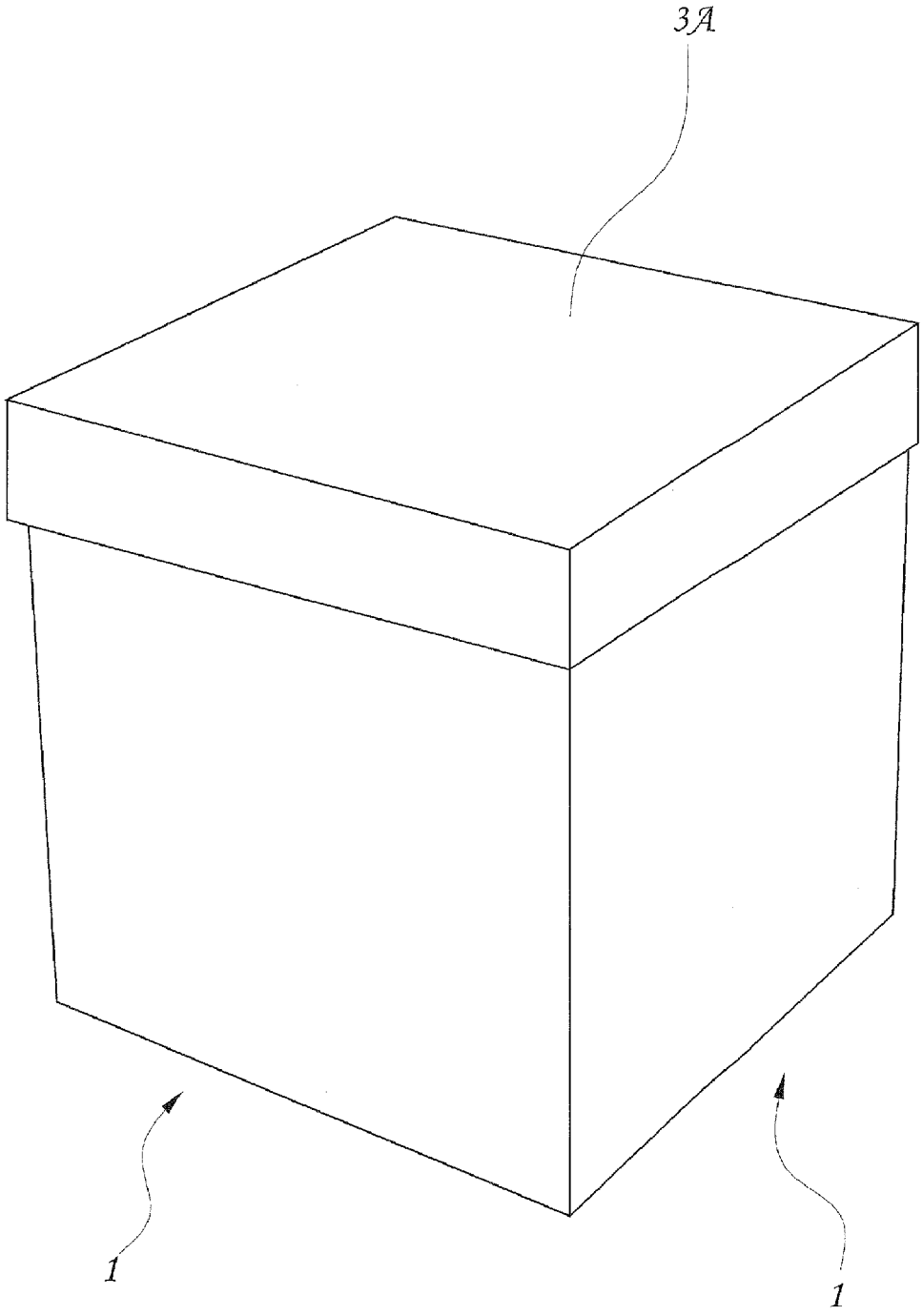
FIG. 6 corresponds to FIG. 5, illustrating the rectangular container cover capped on the combination of the two collapsible triangular storage containers.

Referring to FIGS. 4~6, two collapsible triangular storage containers can be arranged together to have the magnetic members 4 at the first half 11A and second half 11B of the first upright side panel 11 of one collapsible triangular storage container be attached to the magnetic members 4 at the first half 11A and second half 11B of the first upright side panel 11 of the other collapsible triangular storage container, thereby forming a combination rectangular storage container. At this time, a rectangular container cover 3A is capped on the top side of the rectangular storage container.

Figure 7:
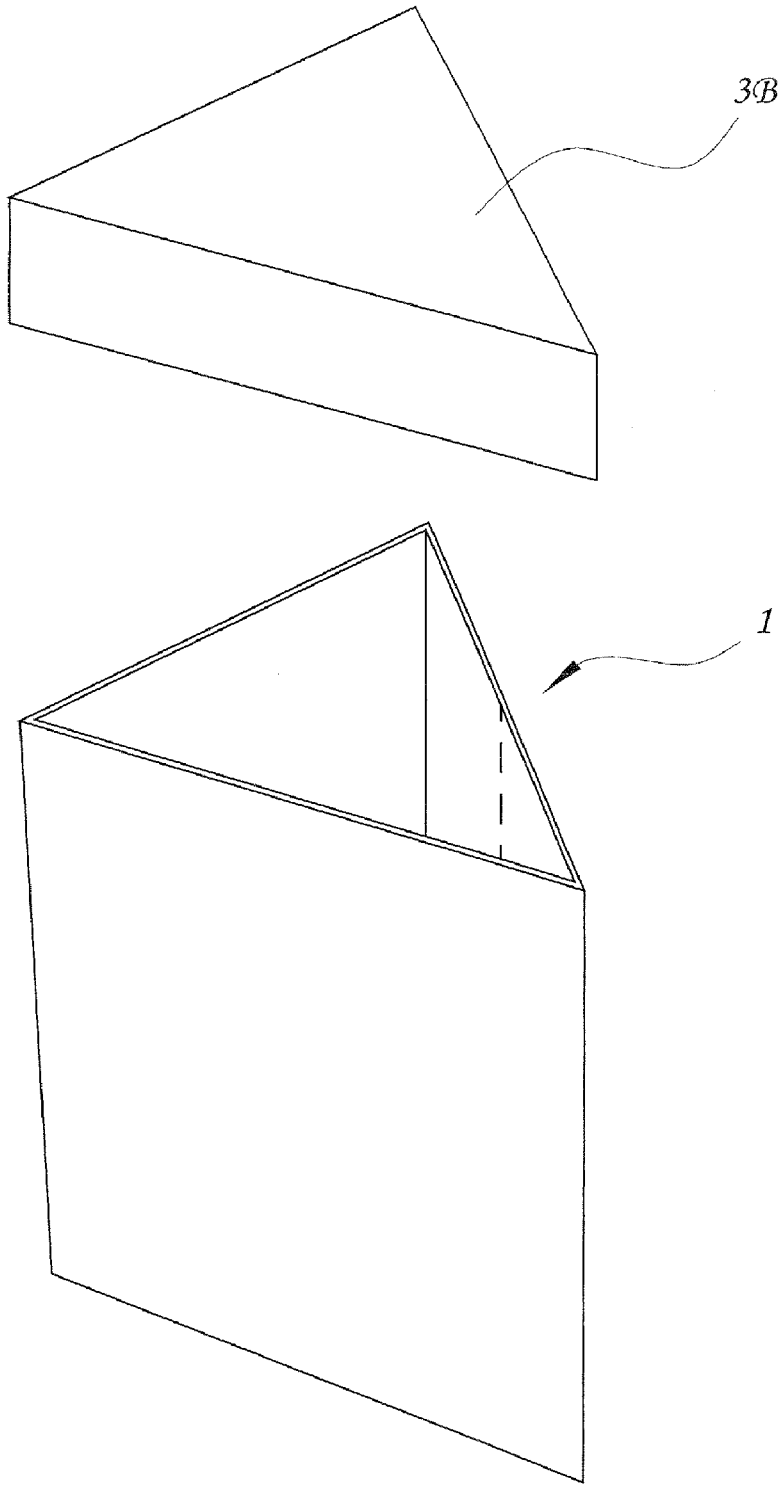
FIG. 7 illustrates the collapsible triangular storage container of the first embodiment of the present invention used with a triangular container cover.
Figure 8:
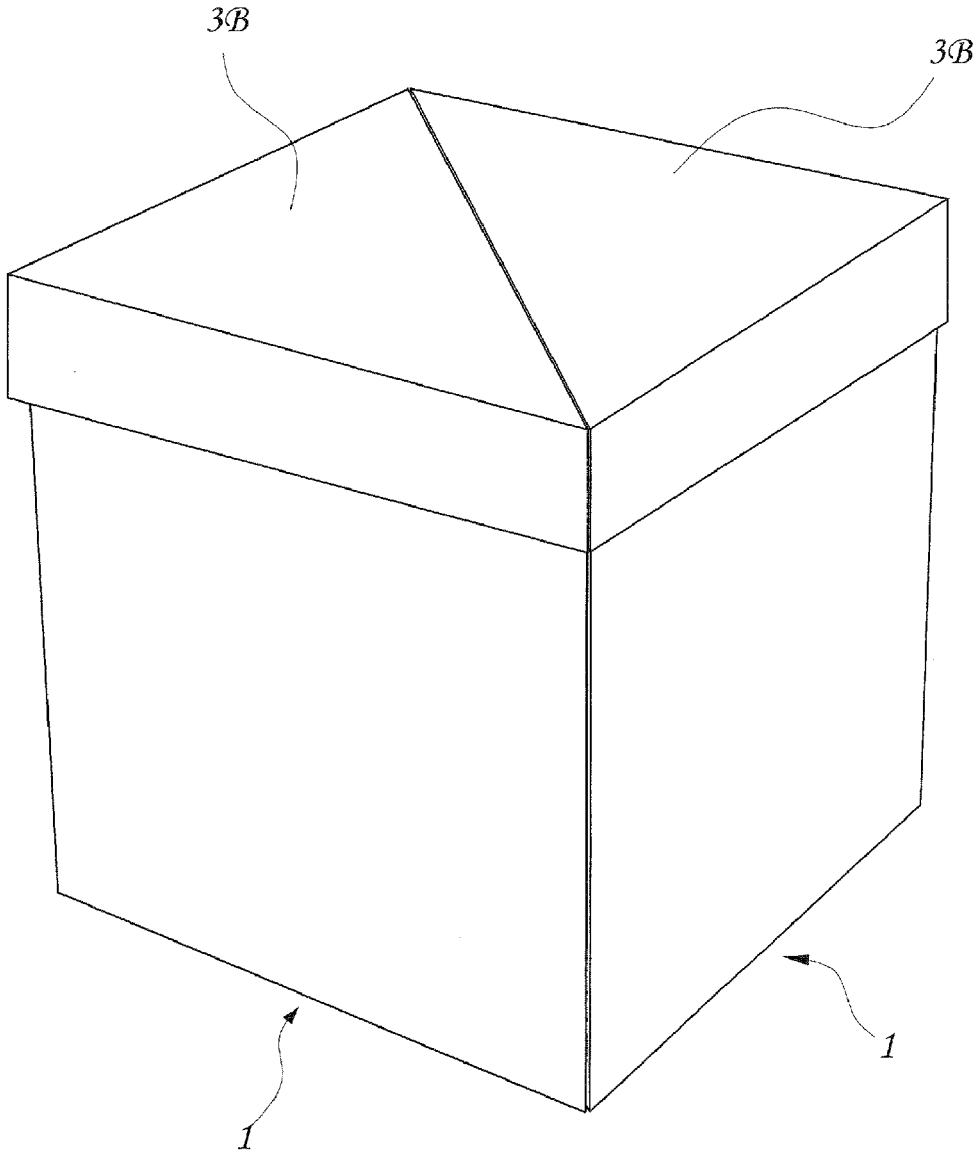
FIG. 8 illustrates two collapsible triangular storage containers respectively covered with a respective triangular container cover and gathered together to form a combination rectangular storage container.
Figure 9:
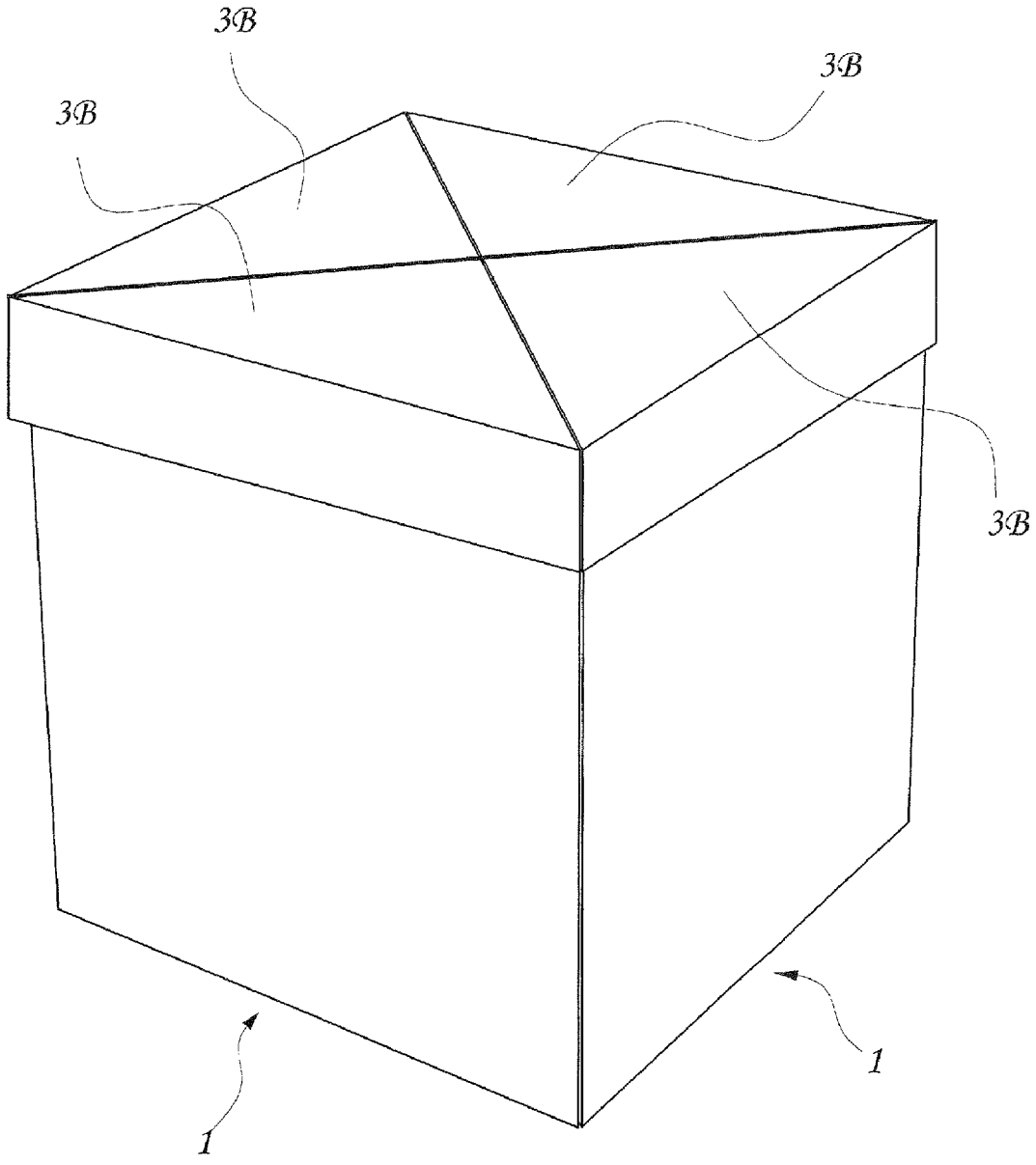
FIG. 9 illustrates four collapsible triangular storage containers respectively covered with a respective triangular container cover and gathered together to form a combination rectangular storage container in accordance with an alternate form of the present invention.

Referring to FIG. 7, the invention further comprises a triangular container cover 3B adapted for covering the top open side of the collapsed triangular container body 1. When two collapsible triangular storage containers are arranged together to form a rectangular storage container, as shown in FIG. 8, the triangular container covers 3B are abutted against each other to constitute a rectangular configuration In the aforesaid embodiment, two collapsible triangular storage containers can be arranged together to form a combination rectangular storage container. As an alternate form of the present invention, as shown in FIG. 9, four collapsible triangular storage containers can be arranged together to form a combination rectangular storage container.

Figure 10:
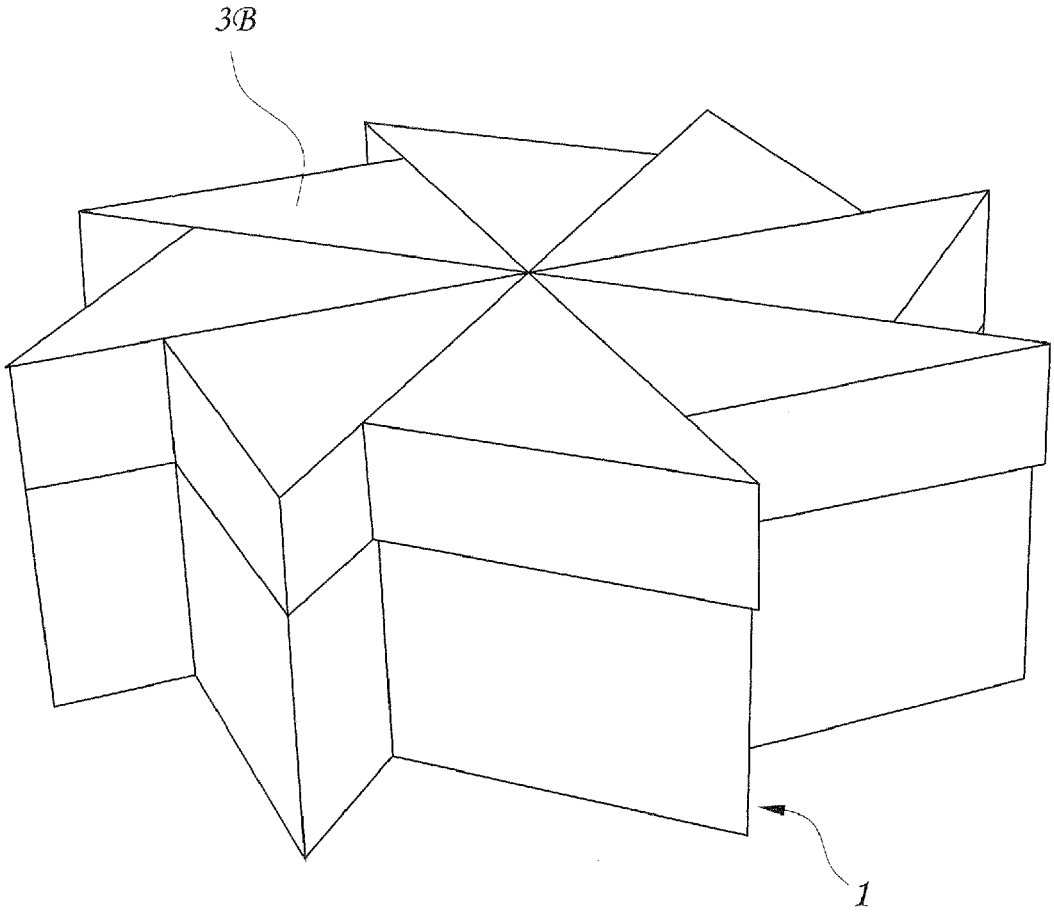
FIG. 10 illustrates another application example of the present invention.

Referring to FIG. 10, multiple collapsible triangular storage containers can be arranged together in a radial manner to constitute a flower pattern where each collapsible triangular storage container is capped with a respective triangular container cover 3B.

Although particular embodiment of the inventions have been described in detail for purposes of illustration, various modifications and enhancements may be made without departing from the spirit and scope of the invention. Accordingly, the invention is not to be limited except as by the appended claims.

I claim:

1. A collapsible triangular storage container-based combination storage container, comprising a plurality of collapsible triangular storage containers attached together to form a rectangular configuration, each said triangular storage container comprising:

a triangular container body comprising a first upright side panel having opposing first and second lateral sides and a folding line vertically extending to opposing top and bottom sides thereof on a middle of the first upright side panel between the opposing first and second lateral sides to divide said first upright side panel into two equal halves for allowing folding of said triangular container body into a collapsed flat condition, a second upright side panel having a first lateral side hinged to the first lateral side of said first upright side panel and a second lateral side, a third upright side panel having a first lateral side hinged to the second lateral side of said second upright side panel and a second lateral side hinged to the second lateral side of said first upright side panel, a soft and collapsible bottom panel horizontally fastened to a bottom side of each of said first upright side panel, said second upright side panel and said third upright side panel and defining with said first upright side panel, said second upright side panel and said third upright side panel a triangular holding space;

a plurality of magnetic members symmetrically and fixedly mounted in the two equal halves of said first upright side panel in reversed directions for creating a magnetic attractive force to secure said two equal halves of said first upright side panel in a stack when said triangular container body is collapsed; and a hard triangular plate member inserted into the inside of said triangular container body and closely attached to said soft and collapsible bottom panel of said triangular container body to support said triangular container body in shape.

2. The collapsible triangular storage container-based combination storage container as claimed in clam 1, wherein each said collapsible triangular storage container further comprises a triangular container cover for covering said triangular container body.

3. The collapsible triangular storage container-based combination storage container as claimed in clam 1, further comprising a rectangular container cover for covering the rectangular configuration of the attached collapsible triangular storage containers.

* * * * *